US005451559A

United States Patent [19]

Smith et al.

[11] Patent Number: 5,451,559

[45] Date of Patent: Sep. 19, 1995

[54] THERMOSENSITIVE RECORDING ELEMENT HAVING IMPROVED SMOOTHNESS CHARACTERISTICS

[75] Inventors: Albert H. Smith, Carrollton, Tex.; Cortland R. Burt, Newark, Del.

[73] Assignee: International Paper Company, Purchase, N.Y.

[21] Appl. No.: 251,679

[22] Filed: May 31, 1994

Related U.S. Application Data

[63] Continuation of Ser. No. 781,556, Oct. 22, 1991, abandoned.

[51] Int. Cl.[6] ..... B41M 5/40

[52] U.S. Cl. ..... 503/200; 503/207; 503/216; 503/217; 503/220; 503/221; 503/226

[58] Field of Search ..... 503/200, 226, 207, 216, 503/220, 217, 221, 210–212; 427/150

[56] References Cited

U.S. PATENT DOCUMENTS

| | | | |
|---|---|---|---|
| 3,965,282 | 6/1976 | Janssens et al. | 503/226 |
| 4,020,232 | 4/1977 | Kohmura et al. | 503/226 |
| 4,061,831 | 12/1977 | Quast | 428/480 |
| 4,255,491 | 3/1981 | Igarashi | 428/537 |
| 4,286,017 | 8/1981 | Nakamura et al. | 428/328 |
| 4,401,721 | 8/1983 | Hida | 503/226 |
| 4,415,633 | 11/1983 | Nakamura et al. | 428/411 |
| 4,444,819 | 4/1984 | Maruta et al. | 346/209 |
| 4,460,626 | 7/1984 | Nakamura et al. | 427/150 |
| 4,467,336 | 8/1984 | Koike | 346/200 |
| 4,551,738 | 11/1985 | Maruta | 346/200 |
| 4,593,298 | 6/1986 | Ikeda et al. | 346/200 |
| 4,682,191 | 7/1987 | Tamagawa et al. | 503/200 |
| 4,708,947 | 11/1987 | Maruyama et al. | 503/209 |
| 4,717,593 | 1/1988 | Igarashi et al. | 427/150 |
| 4,772,581 | 9/1988 | Miyauchi et al. | 503/200 |
| 4,885,271 | 12/1989 | Kawakami et al. | 503/214 |
| 4,889,841 | 12/1989 | Kosaka et al. | 503/209 |

OTHER PUBLICATIONS

Tappi Journal, vol. 71, No. 7, Jul. 1988, A. S. Campbell et al., "Bond paper characteristics for printing by resistive ribbon thermal transfer", pp. 140–144.

Tappi, vol. 63, No. 11, Nov. 1980, Keith E. Bradway, "Comparison of smoothness evaluated by different test methods", pp. 95–98.

*Primary Examiner*—Bruce H. Hess

*Attorney, Agent, or Firm*—Ostrager, Chong & Flaherty

[57] ABSTRACT

A thermosensitive recording element comprising a support having a Sheffield smoothness of less than 60, and at least one layer provided thereon wherein said layer comprises an organic polymeric binder, a substantially colorless electron donating dye precursor and an electron accepting compound capable of forming color by reacting with said dye precursor, wherein the binder, the electron accepting compound and the dye precursor have a particle size of less than about 3μ.

33 Claims, No Drawings

THERMOSENSITIVE RECORDING ELEMENT HAVING IMPROVED SMOOTHNESS CHARACTERISTICS

This is a continuation of application Ser. No. 07/781,556 filed on Oct. 22, 1991, now abandoned.

FIELD OF THE INVENTION

This invention relates to thermosensitive recording elements and, in particular, to thermosensitive recording elements having improved smoothness. Further this invention relates to a process for preparing thermosensitive recording elements having improved smoothness.

BACKGROUND OF THE INVENTION

Thermosensitive recording elements have wide application in the printing industry. For example, thermosensitive recording elements have been used in recording instruments for measurements such as facsimiles, printers, thermal devices for computers, devices for preparing architectural and engineering drawings, automatic vending machines for dispensing railroad tickets and luggage tags, and thermal label printing devices. Conventional thermosensitive recording elements generally comprise a support and a thermosensitive recording layer provided thereon. The thermosensitive recording layer primarily contains a binder, a substantially colorless electron donating dye precursor and an electron accepting compound, also known as a developer. Heat is applied to the element by means of a thermal head, a thermal pen or laser beam, and upon heating, the dye precursor instantaneously reacts with the electron accepting compound to form a recorded image.

Thermosensitive recording elements are typically prepared by finely dispersing the electron donating dye precursor and the electron accepting compound in an aqueous solution of a water soluble binder. For example, U.S. Pat. No. 4,717,593, issued to Igarashi et al. on Jan.5, 1988, describes a heat sensitive recording sheet obtained by applying aqueous dispersions of an electron donating colorless dye and an electron accepting compound to a base. At least one of the aqueous dispersion of the electron donating colorless dye and the aqueous dispersion of the electron accepting compound is prepared by dispersing by means of a horizontal sand mill to obtain an average particle size of about 0.5 to 3 $\mu$m. Dispersions prepared in this manner are coated onto a support such as paper and the coated paper is then dried. The imaging surface of thermosensitive recording elements prepared in this manner is not very smooth. This surface irregularity causes less than optimum contact of the element with the print head of thermal recorders. Thus, non-uniform images are formed. It has been found that passing the finished thermosensitive recording element through a calender produces a smooth coated surface which provides optimum contact with the print head of thermal recorders. However, post coating calendering is disadvantageous in that (1) it requires expensive equipment and (2) it may decrease yields of the finished element and thus cause an increase in manufacturing costs.

Accordingly, a need exists for a thermosensitive recording element having improved smoothness without the disadvantages associated with conventional post coating calendering. It has been found that the thermosensitive elements of the invention overcomes these disadvantages.

SUMMARY OF THE INVENTION

The present invention provides a thermosensitive recording element comprising:

(a) a support having a Sheffield smoothness of less than 60; and (b) at least one layer in contact with the support, said layer comprising an organic polymeric binder, a substantially colorless electron donating dye precursor and an electron accepting compound capable of forming color by reacting with said dye precursor, wherein the binder, the dye precursor and the electron accepting compound have a particle size of less than about 3$\mu$.

In a preferred embodiment of the invention, the thermosensitive recording element comprises:

(a) a support having a Sheffield smoothness of less than 60;

(b) a first layer comprising an organic polymeric binder and a substantially colorless electron donating dye precursor; and (c) a second layer comprising an organic polymeric binder compatible with the binder in (b), an electron accepting compound capable of forming color by reaction with said dye precursor, and a cross-linking agent, wherein the first layer is interposed between the support and the second layer, and wherein the dye precursor and the electron accepting compound have a particle size of less than 3$\mu$.

In another preferred embodiment of the invention, the thermosensitive recording element comprises:

(a) a support having a Sheffield smoothness of less than 60;

(b) a first layer comprising an organic polymeric binder and either a substantially colorless electron donating dye precursor, an electron accepting compound, or mixtures thereof; and (c) a second layer comprising an organic polymeric binder compatible with the binder in (b) and either a substantially colorless electron donating dye precursor or an electron accepting compound, wherein both dye precursor and electron accepting compound are present in the element, wherein the dye precursor and electron accepting compound have a particle size of less than 3$\mu$ and wherein the first layer is interposed between the support and second layer.

Other embodiments of the invention include processes for preparing these thermosensitive recording elements.

DETAILED DESCRIPTION OF THE INVENTION

Surprisingly and unexpectedly, it was found that the use of a support having a Sheffield smoothness less than 60 with a thermosensitive layer applied thereon wherein the layer comprises a dye precursor and an electron accepting compound having a particle size less than 3$\mu$ produced an element having improved surface smoothness. Thus, compared to conventional thermosensitive recording elements, these thermosensitive elements did not have to be calendered to obtain a smooth surface.

The thermosensitive recording element of the invention comprises a support, and a layer in contact with the support comprising an organic polymeric binder, a substantially colorless electron donating dye precursor and an electron accepting compound, wherein the support has a Sheffield smoothness of less than 60, preferably 15–25, and the dye precursor and the electron accepting compound have a particle size of less than 3μ, preferably 0.8–1μ.

In one preferred embodiment, the thermosensitive recording element of the invention comprises a support; a first layer comprising an organic polymeric binder and a substantially colorless electron donating dye precursor; and a second layer comprising an organic polymeric binder compatible with the binder in (b), an electron accepting compound capable of forming color by reaction with said dye precursor, and a crosslinking agent, wherein the first layer is interposed between the support and the second layer, and wherein the support has a Sheffield smoothness of less than 60, and the dye precursor and electron accepting compound have a particle size of less than 3μ.

In another preferred embodiment, the thermosensitive recording element of the invention comprises a support; a first layer comprising an organic polymeric binder and either a substantially colorless electron donating dye precursor, an electron accepting compound, or mixtures thereof; and a second layer comprising an organic polymeric binder compatible with the binder in (b) and either a substantially colorless electron donating dye precursor or an electron accepting compound, wherein the first layer is interposed between the support and second layer and both dye precursor and electron accepting compound are present in the element, and wherein the support has a Sheffield smoothness of less than 60, and the dye precursor and electron accepting compounds have a particle size of less than 3μ.

SUPPORTS

The thermosensitive elements of the invention must contain a support having a Sheffield smoothness of less than 60 and preferably 15–25, to produce an element having improved smoothness. Sheffield smoothness is determined using the method described in TAPPI Test Methods, T 538 om-88, Vol. 1, 1991. Suitable supports include sheet-formed materials such as paper, e.g., 100% bleached Kraft composed of a blend of hard and soft wood, 100% wood free cotton vellum, and wood-containing paper made translucent either by pulp beating or with additives.

Supports may be provided with a sealant layer comprising an inorganic pigment, preferably a blend of inorganic pigments, and a latex sealant. The presence of the sealant layer allows for the reduction in coating weight of the layer or layers containing the dye precursor and the electron accepting compound without sacrificing image density. Some useful pigments include kaolin clay, e.g., calcined kaolin clay; calcium carbonate; titanium dioxide; barium sulfate, talc; etc. A preferred blend of pigments includes kaolin clay (70–80%), calcium carbonate (15–20%), and titanium dioxide (5–20%). Preferably the ratio of the pigments in the blend is 70:15:5%. Some useful latex sealants include acrylic resins, styrene-butadiene type resins, acetates, natural binders such as starches, and blends thereof. The latex preferred sealant is a styrene/butadiene resin having a Tg of 3° C., and a minimum film forming temperature of +5° C. The amount of latex sealant is 8–24% based on the total pigment weight, preferably 19–22%.

ELECTRON DONATING DYE PRECURSOR

The thermosensitive recording element of the invention contain a substantially colorless electron donating dye precursor. By the term "substantially colorless" it is meant having a background optical density less than or equal to 0.10.

Electron donating dye precursors used in ordinary pressure-sensitive recording papers, thermosensitive recording papers, etc., are useful in the present invention. Suitable electron donating dye precursors are disclosed in U.S. Pat. Nos. 4,889,841 issued to Kosaka et al., 4,885,271 issued to Kawakami et al., and 4,467,336 issued to Koike. Specific examples include:

(1) triarylmethane compounds such as 3,3-bis(p-dimethylaminophenyl)-6-dimethylaminophthalide (Crystal Violet lactone), 3,3-bis (p-dimethylaminophenyl)-phthalide, 3-(p-dimethylaminophenyl)-3-(1,2-dimethylindol-3-yl) phthalide, 3-(p-dimethylaminophenyl)-3-(2-methylindol-3-yl) phthalide, 3-(p-dimethylaminophenyl)-3-(2-phenylindol-3-yl) phthalide, 3-3-bis (1,2-dimethyl-indol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.;

(2) diphenylmethane compounds such as 4,4'-bis-dimethylaminobenzhydryl benzyl ether, N-halophenyl leuco Auramine, N-2,4,5-trichlorophenyl leuco Auramine, etc.;

(3) xanthene compounds such as Rhodamine B anilinolactam, Rhodamine B p-chloroanilinolactam, 3-diethylamino-7-dibenzylaminofluoran, 3-diethylamino-7-octylaminofluoran, 3-diethylamino-7-(3,4-dichloroanilino)fluoran, 3-diethylamino-7-(2-chloroanilino) fluoran, 3-diethylamino-6-methyl-7-anilinofluoran, 3-piperidino-6-methyl-7-anilinofluoran, 3-ethyltolylamino-6-methyl-7-anilinofluoran, 3-ethyltolylamino-6-methyl-7-phenylfluoran, 3-diethylamino-7-(4-nitroanilino) fluoran, 3-dibutylamino-6-methyl-7-anilinofluoran, 3-(N-methyl-N-propyl) amino-6-methyl-7-anilinofluoran, 3-(N-ethyl-N-isopropyl) amino-6-methyl-7-anilinofluoran, 3-(N-ethyl-N-tetrahydrofurfuryl) amino-6-methyl-7-anilinofluoran, 3-(N-ethyl-N-isopentyl) amino-6-methyl-7-anilinofluoran; 3-(N-cyclohexyl-N-methyl) amino-6-methyl-7-anilinofluoran; 3-diethylamino-6-methyl-7anilinofluoran; 3-dibutylamino-6-methyl-7-aninofluoran; 3-(N-ethyl-N-(3-ethoxy)propyl)amino-6-methyl-7 anilinofluoran; 3-dipentyl-amino-6-methyl-7-aninofluoran, etc.;

(4) thiazine compounds such as benzoyl leuco methylene blue, p-nitrobenzoyl leuco methylene blue, etc.; and (5) spiro compounds such as 3-methyl-spirodinaphthopyran, 3-ethyl-spirodinaphthopyran, 3,3'-dichlorospirodinaphthopyran, 3-benzyl-spirodinaphthopyran, 3-methylnaphtho-(3-methoxybenzo)-spiropyran, 3-propyl-spirodibenzopyran, etc. Also useful are mixtures of these dye precursors.

Preferred electron donating dye precursors suitable for practicing the invention are (i) 3,3-bis(p-dimethylaminophenyl)-6-dimethylaminophthalide, (ii) 3-(N-ethyl-N-isopentyl)-amino-6-methyl-7-anilinofluoran and (iii) 3-dipentyl-amino-6-methyl-7-aninofluoran. The electron donating dye precursor can be used in the amount of 1 to 15%, preferably 3 to 8% by weight based on the weight of the coating composition.

ELECTRON ACCEPTING COMPOUND

The thermosensitive elements of the invention also comprise an electron accepting compound. Suitable electron accepting compounds, also known as acidic developers, are disclosed in U.S. Pat. Nos. 4,889,841 issued to Kasaka et al., 4,885,271 issued to Kawakami et al., and 4,467,336 issued to Koike. Some specific types of electron accepting compounds include phenol derivatives, aromatic carboxylic acid derivatives, N,N'-diarylthiourea derivatives, and polyvalent metal salts such as zinc salts of organic compounds.

Particularly preferred electron accepting compounds are phenol derivatives. Specific examples include p-octylphenol, p-tert-butylphenol, p-phenylphenol, 1,1bis(p-hydroxyphenyl)propane, 1,1-bis(p-hydroxyphenyl)pentane, 1,1-bis (p-hydroxyphenyl)hexane, 2,2-bis (p-hydroxyphenyl) hexane, 1,1-bis(p-hydroxyphenyl)-2-ethylhexane, 2,2-bis(4'-hydroxyphenyl)propane, 2,2-bis(4-hydroxy-3dichlorophenyl)propane, benzyl p-hydroxybenzoate, ethyl p-hydroxybenzoate, butyl p-hydroxybenzoate, p-p'-dihydroxydiphenylsulfone, 2,2'-diallyl-4,4'-dihydroxydiphenylsulfone, and 2,2'-dimethyl-4,4'-dihydroxydiphenylsulfide. Mixtures of these compounds may also be used.

The electron accepting compounds can be used in the amount of 50 to 500%, preferably 100 to 200%, by weight based on the weight of the dye precursor.

BINDERS

Binders useful for practicing the invention are water soluble binders having a molecular weight of about 20,000 to about 200,000 such as starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers such as poly(vinyl alcohol-co-vinyl acetate) also known as partially hydrolyzed polyvinyl alcohol, sodium alginate, water soluble phenol formaldehyde resins, styrene-maleic anhydride copolymer, ethylene-maleic anhydride copolymer, ethylene vinyl acetate polymers, etc.; latex type water soluble binders such as styrene-butadiene copolymer, acrylonitrile-butadiene copolymer, methyl acrylate-butadiene copolymer, etc., acrylic resins such as poly(methyl methacrylate/ethyl acrylate/acrylic acid), etc.

The organic polymeric binder is present as an aqueous solution having a concentration of about 1 to about 20% by weight, preferably about 3 to about 10% by weight. If the concentration is less than 1%, stability of the dispersed particles will be inferior and cohesion may occur during the heating step. If the concentration is greater than 20%, the viscosity of the dispersion increases remarkably thus requiring a large amount of energy to perform the dispersion.

In the preferred embodiments, where two layers are formed on top of the support, it is important that the binder in the second layer be compatible with the binder in the first layer. By the term "compatible with the binder," it is meant that the binder in the second layer is either identical to or has similar properties to the binder in the first layer. For example, it is important that the two binders are miscible with one another and that they do not chemically react with one another.

CROSSLINKING AGENTS

In one preferred embodiment of the invention, the second layer of the thermosensitive element contains a crosslinking agent. It is believed that the crosslinking agent forms crosslinked acetal linkages with the pendant hydroxyl groups in the polymeric binder. Crosslinking agents useful in practicing the invention are those which are known to crosslink organic polymeric binders, such as mono and polyfunctional aldehydes, e.g., formaldehyde and free dialdehydes, such as glyoxal, succinaldehyde and glutaraldehyde, as described in U.S. Pat. No. 3,232,764 issued to Allen et .al.; and blocked dialdehydes, as described by Kaszuba, U.S. Pat. No. 2,586,168, Jeffreys, U.S. Pat. No. 2,870,013, and Yamamoto et al., U.S. Pat. No. 3,819,608;

Other useful crosslinking agents include (a) $\alpha$-diketones, as described by Allen et al. in U.S. Pat. No. 2,725,305; (b) active esters of the type described by Burness et al., in U.S. Pat. No. 3,542,558; (c) active halogen compounds as described by Burness in U.S. Pat. No. 3,106,468; Silverman et al., U.S. Pat. No. 3,839,042, Ballantine et al., U.S. Pat. No. 3,951,940; and Himmelmann et al., U.S. Pat. No. 3,174,861; (d) s-triazines and diazines, as described by Yamamoto et al., U.S. Pat. No. 3,325,287; Anderau et al., U.S. Pat. No. 3,288,775; and Stauner et al., U.S. Pat. No. 3,992,366; (e) epoxides, as described by Allen et al., U.S. Pat. No. 3,047,394; Burness, U.S. Pat. No. 3,189,459; and Birr et al., German Pat. No. 1,085,663; (f) aziridines, as described by Allen et al., U.S. Pat. No. 2,950,197; Burness et al., U.S. Pat. No. 3,271,175; and Sato et al., U.S. Pat. No. 3,575,705.

Crosslinking agents of mixed function, such as halogen-substituted aldehyde acids, e.g., mucochloric and mucobromic acids, as described by White, U.S. Pat. No. 2,080,019 may also be used in practicing the invention. In addition, vinyl sulfones containing other hardening functional groups, as described by Sera et al., U.S. Pat. No. 4,028,320; and polymeric crosslinking agents, such as dialdehyde starches, as described by Jeffreys et al., U.S. Pat. No. 3,057,723; and copoly(acrolein-methacrylic acid), as described by Himmelmann et al., U.S. Pat. No. 3,396,029 can also be used as crosslinking agents. Some useful polyfunctional aziridines include: Pentaerythritol-tri [$\beta$-(N-aziridinyl)propionate]:

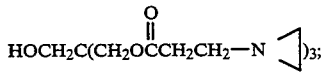

Trimethylolpropane-tri [$\beta$-(N-aziridinyl) propionate]:

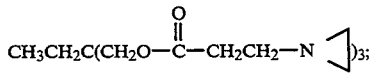

and trimethylolpropane-tri [$\beta$-(N-(methylazridinyl)) propionate]

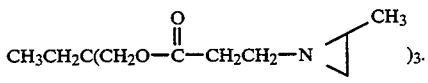

Other polyfunctional aziridines can be employed, e.g., pentaerythritol-tri [$\beta$-(N-(alkyl or dialkyl-substituted aziridinyl))propionate] wherein alkyl is of 1 to 6, preferably 1 to 4, carbon atoms.

Preferred crosslinking agents used in practicing the invention are glyoxal, glutaric dialdehyde, and propionaldehyde. The crosslinking agent is present in the amount of 2 to 6%based on the total layer composition, preferably 3 to 5%.

CATALYST

Catalysts may be used in combination with the crosslinking agent. Suitable catalysts are selected from the group consisting of mineral acids, e.g., hydrochloric, hydrobromic, sulfuric, nitric, phosphoric and boric acids; organic acids, e.g., p-toluenesulfonic, p-dodecylbenzene sulfonic, trichloroacetic, trifluoroacetic, perfluoroheptanoic, acetic, etc.; and an acid from a compound supplying acid, e.g., Lewis acid selected from the group consisting of zinc chloride, zinc bromide, ferric chloride, etc. The preferred catalyst in practicing the invention is p-toluenesulfonic acid. The catalyst is present in the amount of 0.3 to 2% based on the total layer composition, preferably 0.4 to 1%.

ADDITIVES

Additives may be present in the dye precursor-containing layer and the developer-containing layer. Additives suitable for practicing the invention include pigments, waxes, lubricants, activation cosolvents, higher fatty acid metal salts, surface active agents, mold inhibitors, dispersing agents, UV absorbing agents, fluorescent dyes, optical brighteners, defoaming agents, and the like. Also useful are heat fusible materials which may lower the melting point of the dye precursor or developer to improve color sensitivity at low temperatures. Preferably, the waxes and higher fatty acid metal salts are in the uppermost layer where they assist in preventing the thermosensitive element from sticking to or scratching the thermal head of the recording device.

Useful pigments include diatomaceous earth, talc, kaolin, sintered kaolin, calcium carbonate, magnesium carbonate, titanium oxide, zinc oxide, silicon oxide, aluminum hydroxide, urea-formalin resin, etc.

Useful heat fusible materials include B-naphthol benzylether, p-benzylbiphenyl, ethylene glycol m-tolyl ether, m-terphenyl, bis(2-(4-methoxy)phenoxyethyl)ether, dibenzyloxalate, di(p-chlorobenzyl)oxalate, di(p-methylbenzyl)oxalate and dibenzyl terephthalate. These heat fusible materials may be used in the amount of 25–500%, preferably 50 to 200%, by weight based on the weight of dye precursor.

Examples of higher fatty acid metal salts are zinc stearate, calcium stearate. Useful waxes include paraffin, oxidized paraffin, polyethylene, oxidized polyethylene, stearic amide and castor wax. Dispersing agents such as sodium dioctylsulfosuccinate, etc.; UV absorbing agents of the benzophenone type, benzotriazole type etc.; and mold inhibitors such as sodium-o-phenylphenate tetrahydrate, etc., are also useful additives.

DISPERSION PREPARATION AND COATING

Another process is provided for preparing a thermosensitive recording element comprising a support having a Sheffield smoothness of less than 60, and at least one layer provided thereon wherein said layer comprises a binder, a substantially colorless electron donating dye precursor and an electron accepting compound capable of forming color by reacting with said dye precursor wherein the binder, the dye precursor and electron accepting compound have a particle size of less than about 3μ. The process for making such an element comprises the steps of:

(a) providing a support;

(b) preparing a first dispersion of an aqueous solution comprising an organic polymeric binder and a substantially colorless, electron donating dye precursor;

(c) preparing a second dispersion of an aqueous solution comprising an organic polymeric binder, an electron accepting compound capable of forming color by reaction with said dye precursor, wherein the binder is compatible with the binder in (b);

(d) preparing a mixture of the first and second dispersions;

(e) applying the mixture of the first and second dispersions onto the support; and (f) drying the dispersion applied in step (e) to form a first layer on the support, wherein the support has a Sheffield smoothness of less than 60, and the dye precursor and electron accepting compound have a particle size of less than 3μ.

Dispersions of the dye precursor and electron accepting compound are generally prepared with an aqueous solution of the organic polymeric binder as the dispersion medium.

The dispersion containing the dye precursor is prepared by grinding the dye precursor and optionally other suitable additives along with an aqueous solution of the organic polymeric binder in a grinding device such as a ball mill; sand mill such as a horizontal sand mill; an attritor, etc. Preferably a horizontal sand mill containing zirconium silicate media is used. The dispersion is subjected to continuous grinding until an average particle size of 0.5–3μ, preferably 0.8–1μ is obtained.

The electron accepting compound containing dispersion is prepared by grinding the electron accepting compound, aqueous solution of the organic polymeric binder and suitable additives in one of the above described grinding devices until an average particle size of 0.5–3μ, preferably 0.8–1μ, is obtained.

The dye precursor and the electron accepting compound in their respective dispersions have a particles size of about 0.5–3μ, preferably 0.8≧1μ. Thermal response in the thermosensitive element is generally insufficient if the particle size is greater than 3μ. A particles size less than 0.5μ can either result in fogging or require a significant amount of energy to carry out the dispersion.

The dye precursor containing dispersion and the dispersion containing the electron accepting compound are mixed and applied to the support. The applied dispersion is then dried thereby forming a first layer on the support. The ratio of the dye precursor to the electron accepting compound in this layer is in the range of about 1:1 to about 10:1, preferably about 2:1 to about 4:1.

Alternatively, separate dispersions containing either the dye precursor, or the electron accepting compound, may be prepared by grinding the dye precursor or electron accepting compound with an aqueous solution of the organic polymeric binder in a grinding device until the desired average particle size is reached. In preparing the respective dispersions, suitable additives as well as a catalyst may be added. A suitable crosslinking agent is added to the dispersion containing the electron accepting compound. Coating dispersions or compositions may then be prepared by blending the individual dispersions in ratios that produce the desired weight percentage of the individual ingredients as a percentage of total weight of the coating dispersion.

Accordingly, the invention provides a process for preparing a thermosensitive recording element comprising (a) a support having a Sheffield smoothness of less than 60, (b) a first layer comprising an organic polymeric binder and a substantially colorless electron donating dye precursor, and (c) a second layer comprising an organic polymeric binder compatible with the binder in (b), an electron accepting compound capable of forming color by reaction with said dye precursor, and a crosslinking agent, wherein the first layer is interposed between the support and the second layer, and wherein the dye precursor and the electron accepting compound have a particle size of less than 3μ.

The process for making such an element comprises the steps of (a) providing a support;

(b) preparing a first dispersion of an aqueous solution comprising an organic polymeric binder and a substantially colorless, electron donating dye precursor;

(c) preparing a second dispersion of an aqueous solution comprising an organic polymeric binder compatible with the binder in (b), an electron accepting compound capable of forming color by reaction with said dye precursor, and a crosslinking agent;

(d) applying the first dispersion onto the support;

(e) drying the applied first dispersion to form a first layer on the support;

(f) applying the second dispersion on the first layer formed in step (e); and (g) drying the second applied dispersion to form a second layer, wherein the support has a Sheffield smoothness of less than 60, and the dye precursor and electron accepting compound have a particle size of less than 3μ.

Another process for preparing a thermosensitive recording element comprising (a) a support having a Sheffield smoothness of less than 60, (b) a first layer comprising an organic polymeric binder and either a substantially colorless electron donating dye precursor, an electron accepting compound, or mixtures thereof, (c) a second layer comprising an organic polymeric binder compatible with the binder in (b) and either a substantially colorless electron donating dye precursor or an electron accepting compound, wherein both dye precursor and electron accepting compound are present in the element, wherein the dye precursor and electron accepting compound have a particle size of less than 3μ and wherein the first layer is interposed between the support and second layer. The process for making such an element comprises the steps of:

(a) providing a support;

(b) preparing a first dispersion of an aqueous solution of an organic polymeric binder containing a substantially colorless, electron donating dye precursor;

(c) preparing a second dispersion of an aqueous solution of an organic polymeric binder containing an electron accepting compound, wherein the binder is compatible with the binder in (b);

(d) applying either the first dispersion, the second dispersion or a mixture thereof onto the support;

(e) drying the first applied dispersion to form a first layer on the support;

(f) applying either the first dispersion or the second dispersion on the first layer formed in step (e); and (g) drying the dispersion applied in step (f) to form a thermosensitive recording element having a support bearing at least two layers, wherein the support has a Sheffield smoothness of less than 60, and the dye precursor and electron accepting compound have a particle size of less than 3μ.

In each of the above-described processes, the dispersions comprising dye precursor and electron accepting compound are mixed using conventional mixing devices known to one skilled in the art and the dispersion mixture is applied, preferably coated, using any conventional coating apparatus, onto a support, preferably paper, followed by drying at about 25° to 50° C., preferably 45° to 50° C. for 2 to 30 minutes, and more preferably 2 to 5 minutes. The dye precursor in the coated layer is present in the amount of 0.3 g/m$^2$ to 1.6 g/m$^2$, preferably 0.4 g/m$^2$ to 0.8 g/m$^2$. The electron accepting compound in the coated layer is present in the amount of 0.2 g/m$^2$ to 2.7 g/m$^2$, preferably 0.7 g/m$^2$ to 1.3 g/m$^2$. Alternatively, the electron accepting compound is present in an amount equal to 50–100%, preferably 100–200% by weight based on the weight of dye precursor present in the layer. After drying, additional layers may be applied, preferably coated onto the dried first layer followed by drying under the same conditions. It is preferred that drying be conducted in such a fashion that the moisture content of the thermosensitive recording element is within the range of from about 5% by weight to about 9% by weight based on the total weight of the recording element.

Additional layers may be applied to the dried recording element thus described to impart different surface characteristics such as gloss, smoothness, color, resistance to inorganic or organic solvents, or additional abrasion resistance. In an element having more than two layers, it is preferred that the outermost layer of the recording element be free of dye precursor. It has been found that the presence of both dye precursor and electron accepting compound in the outermost layer causes the element to become too heat sensitive which can lead to "image bleeding" or "smearing" from the trailing edge of images. The additional layer or layers may comprise an organic polymeric binder compatible with the binder in the adjacent layer and a dye precursor or an electron accepting compound. It is preferred that the two outermost layers comprise either dye precursor or electron accepting compound. If a crosslinking agent and optionally a catalyst are present in the outermost layer, then the layer should not contain dye precursor or the thermosensitive element will not have improved abrasion resistance. The outermost layer may also contain compounds selected from the group consisting of pigments, waxes, higher fatty acid metal salts, optical brighteners, and mixtures thereof. The cumulative amount of electron accepting compound in all layers of the composition should fall in the range of 50–500%, preferably 100–200% by weight based on the total amount of dye precursor used in the coated material.

EXAMPLES

The following examples further illustrate, but do not limit, the invention. The parts and percentages are by weight unless otherwise noted. Average particle size was measured using a Microtrac Model 7998 SPA Particle Size Analyzer, Leeds & Northrup Co., St. Petersburg, Fla.

EXAMPLE 1

The following ingredients were ground together in a 1.5 liter horizontal grinding mill containing Zirconium Silicate grinding media of 0.6–1.0μ particle size. The dispersions were subjected to continuous grinding in the mill at residence times to 10 minutes/liter of dispersion. Analysis of the resulting dispersions showed they each contained particles with average size of 1–2 microns in diameter:

| INGREDIENT | WEIGHT % |
|---|---|
| Dispersion "A" (Dye precursor Dispersion): | |
| 3-(N-diethyl)-amino-6-methyl-7-anilinofluoran | 6.4 |
| Parabenzylbiphenyl | 6.4 |
| Polyvinylalcohol (7% in water) | 87.2 |
| Dispersion "B" (Electron accepting compound or Developer Dispersion): | |
| p-Hydroxybenzylbenzoate | 6.0 |
| 1,1,3-Tris(2-methyl-4-hydroxy-5-cyclohexyl-phenyl)butane | 1.1 |
| Calcium carbonate | 14.9 |
| Polyvinylalcohol (7% in water) | 78.0 |

Base Paper

The base paper used was 100% bleached Kraft composed of a blend of hard and soft woods and was emulsion sized with synthetic cationic sizing materials. The paper was machine glazed on one surface with a Yankee dryer and then further smoothed by applying an 8.1 g/m$^2$ sealant layer containing inorganic pigments in a styrene-butadiene latex to the machine glazed surface. The inorganic pigments consisted of a blend of kaolin clay (70–80%), calcium carbonate (15–20%), and titanium dioxide (5–20%) and the latex sealant was a styrene/butadiene resin having a Tg of 3° C. and a minimum film forming temperature of +5° C. The resulting sheet had a smoothness of 17–20 Sheffield units as measured according to TAPPI Testing Method T538 om-88, Vol. 1, 1991 and a total base weight of 81.4 g/m$^2$.

Dispersion "A" was then applied to the above described base paper using a Meyer Rod. The coating was dried in an oven to 140° F. (60° C.) until its moisture content was reduced to 6–8% by weight. The coating was white in color and was shown to have a coating weight of 1.63–2.44 g/m$^2$.

Dispersion "B" was then applied to the base paper containing coating from Dispersion "A" using a Meyer Rod. The coated paper was dried in an air oven to 130°–140° F. (54°–60° C.) until its moisture content was shown to be in the range of 6–8% by weight. The total coating thus applied to the base paper was shown to have a coating weight of 3.26–4.88 g/m$^2$. The coated paper was white in color, had low gloss as indicated by a 5–10% total reflection, and was resistant to scratching by fingernail abrasion. The coated paper was shown to have a smoothness of 17–22 Sheffield units on the coated side. It had a background absorbance of 0.02–0.05 O.D. units, as measured by, reflectance densitometry, and produced a black image with a thermal printer with an absorbance of 1.20 O.D. units.

EXAMPLE 2

A dispersion of p-hydroxybenzylbenzoate (15% by weight) and 7% aqueous polyvinylalcohol (85% by weight) was prepared by grinding these ingredients in a horizontal grinding mill until the average particle size was shown to be 0.8–1.0 microns in diameter. The dispersion was blended with dye dispersion "A" from Example 1 in proportions such that the final weight percentage of the resulting Dispersion "C" was as follows:

| Dispersion "C" | |
|---|---|
| INGREDIENT | WEIGHT % |
| 3-(N-diethyl)-amino-6-methyl-7-anilinofluoran | 4.8 |
| Parabenzylbiphenyl | 4.8 |
| p-Hydroxybenzylbenzoate | 2.0 |
| Polyvinylalcohol (7% in water) | 88.4 |

Dispersion "C" was used to coat machine glazed base paper as described in Example 1 using a Meyer Rod and dried as described in Example 1. The resulting white coating was shown to have a coating weight of 1.8–2.8 g/m$^2$. The coated paper had a smoothness of 45 Sheffield units. The coating marked easily if rubbed with a fingernail.

EXAMPLE 3

Dispersion "B" from Example 1 was applied as a top coat over the paper thus coated with Dispersion "C" from Example 2, using a Meyer Rod and dried according to the procedure described in Example 1. The resulting coated paper was white in color, had a background O.D. of 0.02–0.06 and was resistant to marking by vigorous rubbing with a fingernail. It was shown to have a total coating weight of 4.9–6.5 g/m$^2$ and a moisture content of 6–8% by weight. The coated surface of this paper was shown to have a smoothness of 18–25 Sheffield units as measured according to TAPPI Testing Method T538 om-88, Vol. 1, 1991. It produced black images with an absorbance of 1.4–1.70.D. units when printed on a thermal printer.

What is claimed is:

1. A thermosensitive recording element having improved smoothness comprising:

a support that is a sheet material having a Sheffield smoothness of less than 60; and at least one layer in contact with said support, said layer comprising an organic polymeric binder, a substantially colorless electron donating dye precursor and an electron accepting compound, or mixtures thereof which are combined in a ratio of said dye precursor to said electron accepting compound in the range of about 2:1 to about 10:1;

wherein said dye precursor :and said electron accepting compound have a particle size of less than about 3μ;

and the coating formed has a Sheffield smoothness of less than 60 without post coating calendering.

2. The thermosensitive recording element of claim 1 wherein said layer in contact with said support is a first layer; and the element further includes a second layer comprising an organic polymeric binder compatible with said binder in said first layer and either a substantially colorless electron donating dye precursor or an electron accepting compound;

wherein said first layer is interposed between said support and said second layer.

3. The thermosensitive recording element of claim 1 wherein said layer in contact with said support is a first layer comprising said binder and said dye precursor; and the element further includes a second layer comprising an organic polymeric binder compatible with said binder in said first layer, an electron accepting compound and a crosslinking agent;

wherein said first layer is interposed between said support and said second layer.

4. The thermosensitive recording element of claim 3 wherein said crosslinking agent is selected from the group consisting of mono- and polyfunctional aldehydes, blocked dialdehydes, α-diketones, active esters, active halogen compounds, s-triazines, diazines, epoxides, aziridines, halogen-substituted aldehyde acids and vinyl sulfones containing hardening functional groups.

5. The thermosensitive recording element of claim 4 wherein said crosslinking agent is glyoxal.

6. The thermosensitive recording element of claim 4 wherein said crosslinking agent is present in the amount of 2 to 6% based on the total layer coating composition.

7. The thermosensitive recording element of claim 6 wherein said crosslinking agent is present in the amount of 3 to 5% based on the total layer coating composition.

8. The thermosensitive recording element of claim 3 which further comprises a catalyst present in the amount of 0.3 to 2% based on the total layer coating composition.

9. The thermosensitive recording element of claim 1 wherein said support has a Sheffield smoothness of about 15–25.

10. The thermosensitive recording element of claim 1 wherein said support is paper.

11. The thermosensitive recording element of claim 10 wherein said support is selected from the group consisting of 100% bleached Kraft composed of a blend of hard and soft wood, 100% wood free cotton vellum, and translucent wood-containing paper.

12. The thermosensitive recording element of claim 1 wherein said support is provided with a sealant layer.

13. The thermosensitive recording element of claim 12 wherein said sealant layer comprises an inorganic pigment and a latex sealant.

14. The thermosensitive recording element of claim 1 wherein said dye precursor and said electron accepting compound have a particle size of 0.8–1μ.

15. The thermosensitive recording element of claim 1 wherein said dye precursor is selected from the group consisting of triarylmethane compounds, diphenylmethane compounds, xanthene compounds, thiazine compounds and spiro compounds.

16. The thermosensitive recording element of claim 15 wherein said dye precursor is 3,3-bis(p-dimethylaminophenyl)-6-dimethylaminophthalide.

17. The thermosensitive recording element of claim 15 wherein said dye precursor is 3-(N-ethyl-N-isopentyl)-amino-6-methyl-7-anilinofluoran.

18. The thermosensitive recording element of claim 15 wherein said dye precursor is 3-dipentyl-amino-6-methyl-7-anilinofluoran.

19. The thermosensitive recording element of claim 1 wherein said dye precursor is present in the amount of 1 to 15% by weight based on the weight of the total layer coating composition.

20. The thermosensitive recording element of claim 19 wherein said dye precursor is present in the amount of 3 to 8% by weight based on the weight of the total layer coating composition.

21. The thermosensitive recording element of claim 1 wherein said electron accepting compound is selected from the group consisting of phenol derivatives, aromatic carboxylic acid derivatives, and polyvalent metal salts.

22. The thermosensitive recording element of claim 21 wherein said electron accepting compound is 2,2-bis(4'-hydroxyphenyl)propane.

23. The thermosensitive recording element of claim 21 wherein said electron accepting compound is benzyl p-hydroxybenzoate.

24. The thermosensitive recording element of claim 21 wherein said electron accepting compound is 2,2'-diallyl-4,4'-dihydroxydiphenylsulfone.

25. The thermosensitive recording element of claim 1 wherein said electron accepting compound is present in the amount of 50 to 500% by weight based on the weight of said dye precursor.

26. The thermosensitive recording element of claim 25 wherein said electron accepting compound is present in the amount of 100 to 200% by weight based on the weight of said dye precursor.

27. The thermosensitive recording element of claim 1 wherein said organic polymeric binder is a water soluble binder having a molecular weight of 20,000 to 200,000.

28. The thermosensitive recording element of claims 1 wherein said organic polymeric binder is selected from the group consisting of starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers, sodium alginate, water soluble phenol formaldehyde resins, styrene-maleic anhydride copolymer, ethylene-maleic anhydride copolymer, ethylene vinyl acetate polymers, styrene-butadiene copolymer, acrylonitrile-butadiene copolymer and acrylic resins.

29. The thermosensitive recording element of claim 1 wherein said organic polymeric binder is applied from an aqueous solution having a concentration of 1 to 20% by weight.

30. The thermosensitive recording element of claim 29 wherein said organic polymeric binder is applied from an aqueous solution having a concentration of 3 to 10% by weight.

31. The thermosensitive recording element of claim 1 wherein at least one additional layer comprising an organic binder and either a dye precursor or an electron accepting compound is present as an outermost layer.

32. The thermosensitive recording element of claim 31 wherein said additional layer comprises said binder, an electron accepting compound and a crosslinking agent.

33. The thermosensitive recording element of claim 31 wherein said additional layer comprises at least one compound selected from the group consisting of pigments, waxes, higher fatty acid metal salts and optical brighteners.

* * * * *